US005311921A

United States Patent [19]

Smets

[11] Patent Number: 5,311,921

[45] Date of Patent: May 17, 1994

[54] DEVICE FOR THE CONTINUOUS ADDITION OF CASTING AUXILIARIES ONTO THE SURFACE OF A MELT IN A CONTINUOUS-CASTING MOLD

[75] Inventor: Hans-Friedrich Smets, Meerbusch-Lank, Fed. Rep. of Germany

[73] Assignee: Intocast GmbH Feuerfestprodukte und Giesshilfsmittel, Ratingen, Fed. Rep. of Germany

[21] Appl. No.: 966,058

[22] PCT Filed: May 17, 1991

[86] PCT No.: PCT/DE91/00398

§ 371 Date: Jan. 11, 1993

§ 102(e) Date: Jan. 11, 1993

[87] PCT Pub. No.: WO92/00819

PCT Pub. Date: Jan. 23, 1992

[30] Foreign Application Priority Data

Jul. 11, 1990 [DE] Fed. Rep. of Germany ..... 4022117

[51] Int. Cl.[5] ..... B22D 11/10

[52] U.S. Cl. ..... 164/268; 164/422; 222/318

[58] Field of Search ..... 164/268, 472, 473; 222/318

[56] References Cited

FOREIGN PATENT DOCUMENTS 63-123555 5/1988 Japan ..... 164/473

*Primary Examiner*—Kuang Y. Lin

*Attorney, Agent, or Firm*—Foley & Lardner

[57] ABSTRACT

A pulverulent casting auxiliary (6) is removed from a supply tank (1) in the fluidized state and conveyed through a screw conveyor (10) via a continuous-casting mold (12). At the end of the screw conveyor (10) a return line (30) is provided via which the quantity of casting auxiliary (6) not removed at the removal points (19) disposed over the bath surface (18) is returned into the supply tank (1) in a circulating manner.

5 Claims, 1 Drawing Sheet

DEVICE FOR THE CONTINUOUS ADDITION OF CASTING AUXILIARIES ONTO THE SURFACE OF A MELT IN A CONTINUOUS-CASTING MOLD

The invention relates to a device of the type corresponding to the precharacterizing clause of claim 1.

The preferred field of application of the invention is the addition of continuous-casting flux powder onto the bath surface of a continuous-casting mold. These continuous-casting flux powders form a layer several centimeters thick on the bath surface. They fuse in their region in contact with the bath surface and form a slag, which is deposited between the mold wall and the solidifying billet. The upper portion of the flux powder layer, which is still loose, acts as thermal insulation and prevents too great a heat loss from the upper billet end.

Entrainment of the molten flux powder slag results in a continuous consumption of flux powder. This consumption is in the region of approx-imately 0.3 kg to 0.8 kg per tonne of steel. This quantity must thus be continuously resupplied, the maintenance of a uniform layer thickness being essential for the quality of the billet surface. Uniformity must be sought both in a vertical as well as in a horizontal direction. Uniformity in the vertical direction means maintaining a certain layer thickness during the entire duration of casting in order continuously to ensure the availability of a sufficient quantity of slag. Uniformity in the horizontal direction means the uniformity of this layer thickness over the billet cross section, in order to obtain a uniform insulating effect at each point.

The starting point of the development was the manual addition of the continuous-casting flux powder. The uniformity of this is not always ensured. This method also requires the presence and continuous attention of an operating person over the entire casting sequence lasting several hours.

It was attempted early on to automate the addition of casting auxiliaries during continuous casting. Two different procedures are known for this, namely devices operating in a pneumatic-mechanical manner or a purely mechanical manner using conveyors, on the one hand, and, on the other hand, devices which operate utilizing gravity.

In a known device of the first ground, a flat conveying channel disposed at the lower end of a supply tank extends from the side to above the continuous-casting mold. Below the supply tank is disposed a gas distribution chamber into which air can be blown, which fluidizes the flux powder situated in the channel and makes it transportable. When air is blown in, there is thus a conveying effect from the supply tank through the channel to the bath surface in the continuous-casting mold. When the air is shut off, the conveying also stops. The control is carried out via temperature-measuring sensors, which are disposed above the mold. If the flux powder layer on the bath surface becomes thinner and the insulating effect of the powder decreases, the temperature increases and the addition of the powder is initiated. This thus takes place not continuously but intermittently, in a similar manner to manual feed. With the automatic powder addition described, an improvement of the billet surface compared with manual powder addition cannot be expected. This has also been confirmed in practice. Pneumatic-mechanical metering devices have not proven themselves and they have not been accepted in practice.

The devices operating purely according to the principle of gravity were first conceived also for the use of pulverulent casting auxiliary. An inclined feed tube leads from a supply tank to above the bath surface. The quantity dispensed forms a conical pile on the bath surface which rises up to the lower end of the feed tube. No more powder then pours down. Only when the conical pile moves away again from the lower end of the tube by consumption does new powder trickle down. This type of automatic control is also called the "chicken feeding" principle because it is widespread in automatic feeding equipment. It has been found, however, that pulverulent casting auxiliaries cannot be reliably applied using this method, since, even with feed tubes disposed at a steep angle (angle $>30°$), blockages occur in the feed tube.

It was therefore necessary to granulate the casting auxiliary in order to counteract the tendency of blockage of the feed tube to occur. With granules, the addition under a pure gravitational effect could be designed in a functionally more reliable manner. With exact control of the level of the casting surface, the thickness of the layer of granules is always constant thereby ensuring a uniform insulation and a constant availability of slag corresponding to the specific slag-formation activity of the granules.

However, the requirements for the quality of the granules is high. It was found that granules whose particle-size range was less uniform led, like pure powders, to blockages in the feed tube. The use of graded granules with a narrow particle-size range places a considerable economic burden on the process.

If the continuous addition of flux powder granules is to be economically rational, there is an additional prerequisite that the granules be pneumatically conveyed and that they do not have to be transported onto the casting platform in sacks or big bags using floor conveyors or fork-lift trucks for feeding the supply tank of the feed device. Only if pneumatic conveying is possible can the granules be delivered into a silo vehicle, blown into a silo with considerable effective volume while positioned standing on the plant floor and from there pneumatically conveyed to the supply tank, in order to ensure in this manner a continuous supply of the flux powder to the supply tank while precluding the transport of bags or sacks of granules to the casting platform. The elimination of transporting the granules in bags or sacks to the supply tank reduces the number of workers required for the casting process. Pneumatic conveying is thus - especially in sequence casting - a principal condition for the continuity of the complete casting sequence and for reducing the required manpower associated therewith.

The granules of casting auxiliaries, especially of continuous-casting flux powder, which per se permit a functioning addition only under the effect of gravity, possess, however, especially if they are provided as hollow beads, an abrasion resistance so low that they are broken up during pneumatic conveying and pass partly as powder or fragments into the supply tank of the feed device. Then, however, the abovementioned effect of blockage in the feed tube occurs. Thus for economical reasons as well as for technical reasons, the granules are not suitable for a practicable metering of continuous-casting flux powder.

Many of the aforementioned problems are solved in the patent FR-A-2,463,397 underlying the precharacterizing clause of claim 1. The device comprises a screw conveyor extending transversely above the mold and having outlet nozzles from which the flux powder emerges only with compressed air assistance. The compressed air assistance is provided in a certain time cycle or under control according to the progress of the cast billet or the discovery of a breach in the slag layer. The complexity of control and pneumatics required for this is considerable and subject to malfunction. The compressed air assistance is not possible without dust generation.

The invention is based on the object of further developing the conventional screw conveyer device in such a manner that an optimum addition of flux powder is possible using simpler means.

This object is achieved by providing a device for the continuous addition of casting auxiliary in powder form onto a bath surface of a melt. The device comprises a continuous-casting mold containing the melt, with the continuous-casting mold having a top surface; a tundish having a bottom surface; a screw conveyer disposed between the top surface of the continuous-casting mold and the bottom surface of the tundish; a supply tank having the casting auxiliary therein, the supply tank being connected to the screw conveyer to allow the casting auxiliary to pass from the supply tank into the screw conveyer; a plurality of removal shafts in communication with an interior of the screw conveyer, each of the plurality of removal shafts having a lower end which is located a predetermined distance above the bath surface; and a return line connecting an end of the screw conveyer to the supply tank. The screw conveyor receives the casting auxiliary from the supply tank and conveys the casting auxiliary through the interior of the screw conveyer such that at each of the plurality of removal shafts a portion of the casting auxiliary passes therethrough and exits from the lower end of each of the plurality of removal shafts onto the bath surface, the casting auxiliary which does not pass through the plurality of removal shafts is returned to the supply tank via the return line. The predetermined distance ensures that the portion of casting auxiliary removed at each of the plurality of nozzles is self-regulated by a chicken feeding principle, and a capacity of the screw conveyer to convey the casting auxiliary is at least twice as large as a capacity of all of the plurality of nozzles to remove the casting auxiliary from the screw conveyer.

Experiments have shown that the circulating conveying of the pulverulent casting auxiliary within the claimed apparatus together with continuous removal of the regulated amount of pulverulent casting via the nozzles above the bath surface permits a reliable mode of operation in which the nozzles do not become blocked. In this process no local pressure increases occur which could lead to a compaction of the pulverulent casting auxiliary which could the cause blockage of the nozzles.

The dimensioning of the conveying capacity of the screw conveyor at twice the removal rate of the pulverulent casting auxiliary from the nozzles ensures a largely uniform filling of the screw conveyor during operation of the apparatus such that uniform conditions exist at the individual removal nozzles. By having uniform conditions at each nozzle, uniform quantities emerge and the delivery of pulverulent casting auxiliary is constantly ensured at the individual removal nozzles.

The use of the "chicken feeding" principle permits an automatic consumption-dependent metering, in a simple manner, without external initiation means such as compressed air and without generation of dust.

The "chicken feeding" principle for the feeding of casting auxiliaries is known per se from GB-A-2,116,092.

Since the screw conveyor extends over the bath surface, it is advisable to cool the screw conveyer, preferably with air. Although the bath surface itself is covered by the pulverulent casting auxiliary, a dip pipe from the tundish will typically extend in the direct vicinity of the screw conveyor and into the upper end of the billet. This dip pipe is typically at a temperature in the order of magnitude of 1000° C.

In another embodiment it is desirable that the device include a plurality of removable nozzles each of which extend from end form the lower end of a corresponding one of the plurality of removal shafts, each of the plurality of removable nozzles being formed from a metal having a lower melting point than a melting point of the metal of the melt. The removable nozzles can consist, for example, of aluminum. They form at their lower edge the delimitation of the removal point of the casting auxiliary up to which a conical pile of casting auxiliary rises. In case of wear, the removable nozzles are simply exchanged. Likewise when it is required to switch over to a different conical pile height, the removable nozzles can be replaced without the entire screw conveyor having to be modified relative to its height above the continuous-casting mold. In yet another embodiment, the supply tank includes a fluidizing bed which fluidized the casting auxiliary therein.

The fluidization loosens the amount of pulverulent casting auxiliary in the supply tank and makes it quasi free-flowing, so that it passes easily out of the supply tank into the conveying screw.

For the practical execution of relatively long casting sequences it is advisable to provide a large silo for pneumatic refilling of the supply tank, so that the supply tank does not have to be constantly refilled manually.

An exemplary embodiment of the invention is schematically illustrated in the drawing.

Figure 1:
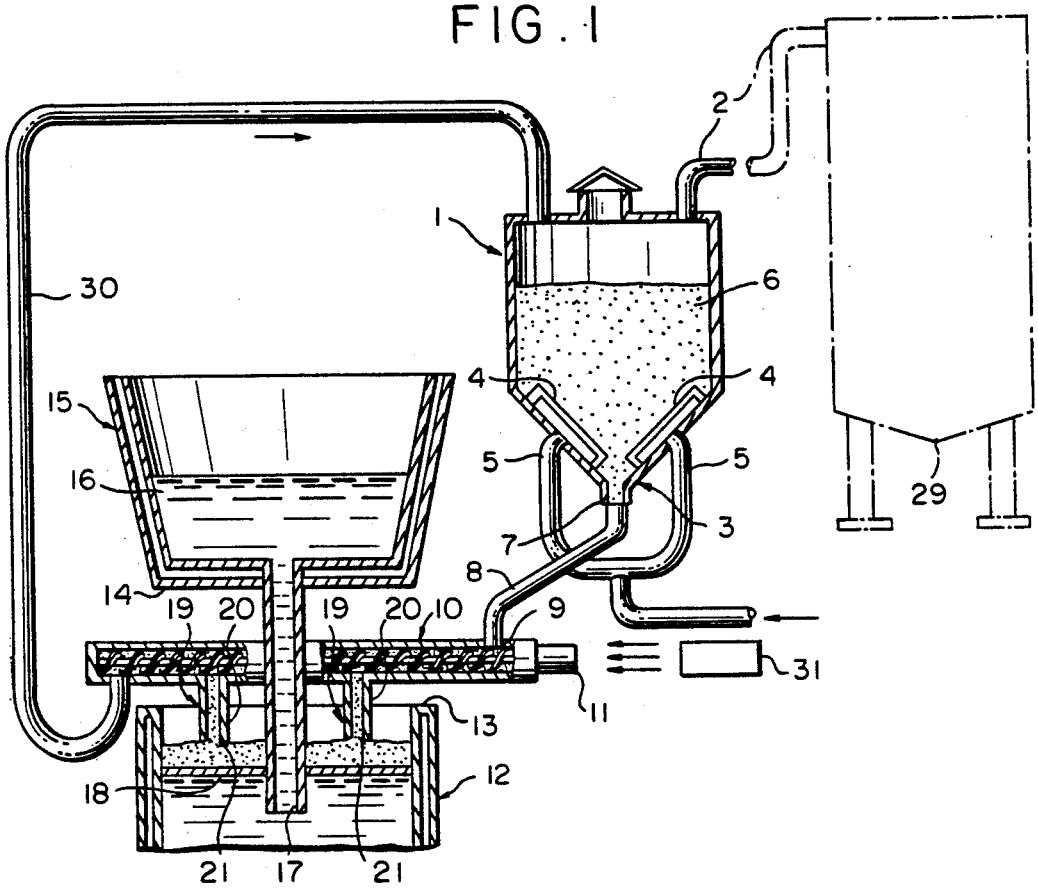
FIG. 1 shows a view of the feed device according to the invention.

FIG. 1 shows a supply tank 1, which is kept filled from a large silo 29, which is only indicated, via a pneumatic conveying line 2. In the conical lower part 3 of the supply tank 1 fluidizing plates 4 are internally disposed, which are fed with air via supply lines 5 and fluidize the continuous-casting flux powder 6 disposed in the supply tank 1, i.e. transforms it into a swirled state in which it is readily mobile. The fluidized continuous-casting flux powder 6 flows from the outlet 7 at the lower end of the conical part 3 of the supply tank 1 via the line 8 into the inlet 9 of a horizontal screw conveyor 10, which is driven by a drive motor 11.

The screw conveyor 10 extends close above the upper end of the continuous-casting mold 12. It has an external diameter of only about 50 mm and therefore fits readily into the narrow intermediate space between the upper edge 13 of the continuous-casting mold 12 and the underside 14 of the tundish 15 disposed above the continuous-casting mold 12, which tundish contains the molten steel 16 which passes via a dip pipe 17 in the base of the tundish 15 into the continuous-casting mold 12. The dip pipe 17 extends into the melt disposed in the continuous-casting mold 12, i.e. extends up to below the bath surface 18, which is kept at a uniform level by suitable measures.

On the underside of the screw conveyor 10 are provided removal points 19 in the form of mutually parallel removal shafts 20, the lower limit 21 of which is disposed at a predetermined distance above the bath. surface 18, which distance is generally the same for all removal shafts.

The screw conveyor 10 comprises a tubular housing 22 in which a transport screw 23 is disposed so as to be rotatable. The housing 22 has at the removal points 19 openings 24 to which the removal shafts 20 are welded. The material transported by the transport screw 23 past the opening 24 emerges downwards through the opening 24 and forms, since it is flowable, a conical pile 25 of pulverulent casting auxiliary. When the conical pile 25 has risen up as far as the lower limit 21 of the removal shaft 20, no further pulverulent casting auxiliary 6 flows down. However, this recurs as soon as the conical pile 25 lowers as a result of the fusion of the pulverulent casting auxiliary 6. This type of self-regulation is known as the "chicken feeding" principle. An equilibrium state results in which the continuous-casting flux powder slowly continues to flow as determined by the consumption.

A uniform layer 26 of molten casting auxiliary, i.e. a slag, forms on the bath surface 18 of the melt 16 in the continuous-casting mold 12, which slag is carried over the meniscus of the bath surface 18 by the billet between the exterior side thereof and the interior circumference of the continuous-casting mold 12. This results in a consumption which causes a lowering of the conical pile 25. It must be ensured that a certain minimum pile height 27 of pulverulent casting auxiliary remains so that the thermal insulation effect is maintained.

Figure 2:
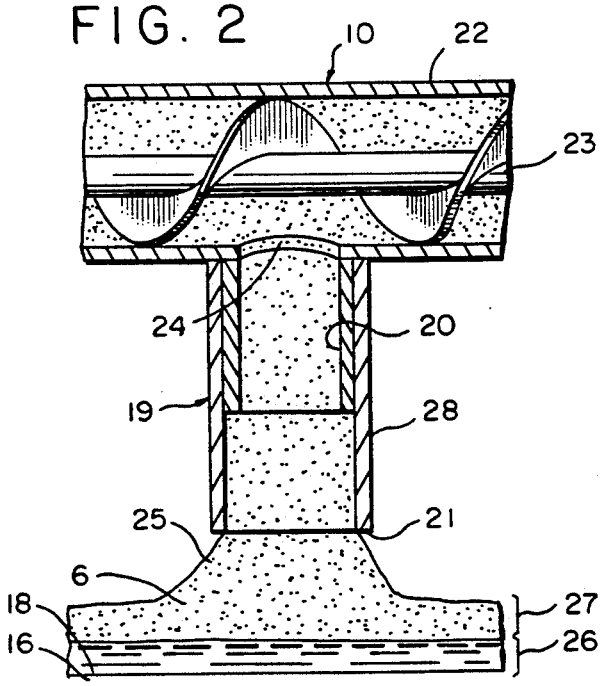
FIG. 2 shows a view of an individual removal point above the bath surface.

In the exemplary embodiment shown in FIG. 2, the lower limit of the removal point 19 is formed not at the removal shaft 20 but at a removal nozzle 28, for example of aluminum, pushed over this shaft, which can be replaced if its lower end is melted or if a different level of the pouring cone 25 is desired.

It is essential that no build-up forms at the end on the left in FIG. 1 of the screw conveyor 10, but that the quantity of pulverulent casting auxiliary not removed at the removal points 19 is fed back into the supply tank 1 via a return line 30. The casting auxiliary 6 thus circulates continuously from the supply tank 1 via the line 8, the screw conveyor 10 and the return line 30. Only the quantities required at the self-regulating removal points 19 are continuously removed from the circulating flow. Indeed, because of the self-regulation according to the "chicken feeding" principle, it is not important that the screw conveyor 10 independently meters to all removal points exactly equally; this metering is carried out at the lower limits 21 of the removal shafts 20 when they are reached by the conical piles 25. The internal pressure in the screw conveyor 10, however, also plays a certain role for the outlet quantities and should therefore be as constant as possible, which means that the degree of powder filling in the screw conveyor 10 should be as constant as possible over its entire length. Only by this means is it guaranteed that substantially the same conditions are present everywhere, also as regards pressure, which contributes to the fact that truly equal quantities of powder flow out at all removal points 19, irrespective of their position. The constancy of the degree of powder filling is better the greater the conveying capacity of the screw conveyor 10 in relation to the removed amounts. In practice the conveying capacity must be at least double these quantities.

A conventional device 30 for blowing air is provided. The device 31 blows air (indicated by arrows) along the screw conveyor 10 in order to keep it cool.

I claim:

1. A device for the continuous addition of casting auxiliary in powder form onto a bath surface of a melt, the device comprising:

a continuous-casting mold containing the melt, the continuous-casting mold having a top surface;

a tundish having a bottom surface;

a screw conveyer disposed between the top surface of the continuous-casting mold and the bottom surface of the tundish;

a supply tank having the casting auxiliary therein, the supply tank being connected to the screw conveyer to allow the casting auxiliary to pass from the supply tank into the screw conveyer;

a plurality of removal shafts in communication with an interior of the screw conveyer, each of the plurality of removal shafts having a lower end which is located a predetermined distance above the bath surface; and a return line connecting an end of the screw conveyer to the supply tank;

wherein said screw conveyer receives the casting auxiliary from the supply tank and conveys the casting auxiliary through the interior of the screw conveyer such that at each of the plurality of removal shafts a portion of the casting auxiliary passes therethrough and exits from the lower end of each of the plurality of removal shafts onto the bath surface, and the casting auxiliary which does not pass through the plurality of removal shafts is returned to the supply tank via the return line;

wherein the predetermined distance ensures that the portion of casting auxiliary removed at each of the plurality of removal shafts is self-regulated by a chicken feeding principle, and a capacity of the screw conveyer to convey the casting auxiliary is at least twice as large as a capacity of all of the plurality of removal shafts to remove the casting auxiliary from the screw conveyer.

2. A device according to claim 1, further comprising means for cooling the screw conveyor.

3. A device according to claim 1, further comprising a plurality of removable nozzles each of which extend from and form the lower end of a corresponding one of said plurality of removal shafts, each of the plurality of removable nozzles being formed from a metal having a lower melting point than a melting point of the metal of the melt.

4. A device according to claim 1, wherein the supply tank includes a fluidizing bed which fluidizes the casting auxiliary in the supply tank and the screw conveyor is connected to a region of the supply tank in which the casting auxiliary is present in a fluidized state.

5. A device according to claim 1, further comprising a silo which pneumatically refills the supply tank with casting auxiliary.

* * * * *